US011453470B2

(12) United States Patent
Sato

(10) Patent No.: US 11,453,470 B2
(45) Date of Patent: Sep. 27, 2022

(54) MARINE VESSEL ELECTRIC PROPULSION SYSTEM, AND MARINE VESSEL INCLUDING THE SAME

(71) Applicant: YAMAHA HATSUDOKI KABUSHIKI KAISHA, Iwata (JP)

(72) Inventor: Taichi Sato, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 55 days.

(21) Appl. No.: 17/158,096

(22) Filed: Jan. 26, 2021

(65) Prior Publication Data

US 2021/0253213 A1 Aug. 19, 2021

(30) Foreign Application Priority Data

Feb. 17, 2020 (JP) ..... JP2020-024446

(51) Int. Cl.

| | |
|---|---|
| ***B63H 21/17*** | (2006.01) |
| ***B63H 20/02*** | (2006.01) |
| ***B63H 20/08*** | (2006.01) |
| ***B63H 21/21*** | (2006.01) |

(52) U.S. Cl.

CPC ..... *B63H 21/17* (2013.01); *B63H 20/02* (2013.01); *B63H 20/08* (2013.01); *B63H 21/21* (2013.01); *B63H 21/213* (2013.01); *B63H 2021/216* (2013.01)

(58) Field of Classification Search

CPC ..... B63H 21/17; B63H 21/21; B63H 21/213; B63H 20/02; B63H 20/08; B63H 2021/216

See application file for complete search history.

(56) References Cited

U.S. PATENT DOCUMENTS

| | | | | |
|---|---|---|---|---|
| 3,598,947 | A | 8/1971 | Osborn | |
| 6,054,831 | A | 4/2000 | Moore et al. | |
| 6,369,542 | B1 | 4/2002 | Knight | |
| 10,745,096 | B2 * | 8/2020 | Clark | B63B 35/40 |
| 2013/0027130 | A1 * | 1/2013 | Ubbesen | H03G 3/004 330/127 |
| 2016/0016651 | A1 | 1/2016 | Anderson et al. | |
| 2016/0090165 | A1 | 3/2016 | Suzuki et al. | |
| 2018/0134354 | A1 | 5/2018 | Suzuki et al. | |

FOREIGN PATENT DOCUMENTS

JP 2016-068757 A 5/2016

OTHER PUBLICATIONS

Official Communication issued in corresponding European Patent Application No. 21157598.0, dated Jun. 23, 2021.

* cited by examiner

*Primary Examiner* — Stephen P Avila

(74) *Attorney, Agent, or Firm* — Keating and Bennett, LLP

(57) ABSTRACT

A marine vessel electric propulsion system includes an electric motor, a propulsive force generator to be driven by the electric motor to generate a propulsive force, an operator to be operated by a user to adjust the power output of the electric motor, and a controller. The controller is configured or programmed to control the power output of the electric motor based on an operation of the operator, and to change a power output gain characteristic of the electric motor with respect to an operation amount of the operator in response to a gain change command.

11 Claims, 6 Drawing Sheets

MARINE VESSEL ELECTRIC PROPULSION SYSTEM, AND MARINE VESSEL INCLUDING THE SAME

CROSS REFERENCE TO RELATED APPLICATIONS

This application claims the benefit of priority to Japanese Patent Application No. 2020-024446 filed on Feb. 17, 2020. The entire contents of this application are hereby incorporated herein by reference.

BACKGROUND OF THE INVENTION

1. Field of the Invention

The present invention relates to a marine vessel electric propulsion system and a marine vessel including the same.

2. Description of the Related Art

US 2018/0134354 A1 discloses a marine vessel including an electric propulsion unit and an engine propulsion unit. The electric propulsion unit uses an electric motor as a power source, while the engine propulsion unit uses an internal combustion engine as a power source. The electric propulsion unit is less noisy, and better in maneuvering stability during low speed sailing as compared with the engine propulsion unit. During high speed sailing, on the other hand, a sufficient propulsive force can be provided by utilizing a higher power output of the engine propulsion unit.

Different operators are respectively provided for the electric propulsion unit and the engine propulsion unit, such that the power outputs of the electric propulsion unit and the engine propulsion unit are individually adjusted. Specifically, a joystick is provided for the electric propulsion unit. The power output of the electric propulsion unit is changed according to the tilt amount of the joystick. Further, a shift lever is provided for the engine propulsion unit. The power output of the engine propulsion unit is changed according to the tilt amount of the shift lever. The mode is switched between an electric mode using the electric propulsion unit and an engine mode using the engine propulsion unit by a mode switch.

SUMMARY OF THE INVENTION

The inventor of preferred embodiments of the present invention described and claimed in the present application conducted an extensive study and research regarding a marine vessel electric propulsion system, such as the one described above, and in doing so, discovered and first recognized new unique challenges and previously unrecognized possibilities for improvements as described in greater detail below.

If the electric propulsion unit is capable of generating a high power output required for high speed sailing, there is no need to provide the engine propulsion unit. For example, a small-scale marine vessel often does not need to generate a high power output which can be generated only by the engine propulsion unit. Where only the electric propulsion unit is provided, the marine vessel may have a single operation system. That is, there is no need to provide both the shift lever and the joystick in the marine vessel as described in US 2018/0134354 A1, obviating the need for performing a complicated operation by selectively using the shift lever and the joystick based on the circumstances.

In view of the foregoing, the inventor of preferred embodiments of the present invention studied an operation system for a marine vessel including only the electric propulsion unit, and discovered a new problem to be detailed below.

The full power output range (0% to 100%) of the electric propulsion unit is allocated to the full operation range (0% to 100%) of the operator, such that the power output of the electric propulsion unit is able to be adjusted within the full range from the minimum level (stop level) to the maximum level. Such an operation-power output characteristic is advantageous during high speed sailing, but is not necessarily advantageous during low speed sailing. This is because the power output is changed in a larger amount with respect to the change in operation amount, making it difficult to finely adjust the power output. If the full operation range of the operator is allocated to a portion (e.g., 0% to 50%) of the power output range of the electric propulsion unit, it may be possible to finely adjust the power output. In this case, however, the capacity of the electric propulsion unit cannot be fully utilized, thus sacrificing the ability for high speed sailing.

To overcome this, preferred embodiments of the present invention provide marine vessel electric propulsion systems each of which satisfies requirements for both the maneuverability during low speed sailing and the power output capacity during high speed sailing, and marine vessels including such marine vessel electric propulsion systems.

Preferred embodiments of the present invention provide marine vessel electric propulsion systems that are able to be driven based on circumstances and a user's preference while reducing energy consumption, and marine vessels including the marine vessel electric propulsion systems.

In order to overcome the previously unrecognized and unsolved challenges described above, a preferred embodiment of the present invention provides a marine vessel electric propulsion system including an electric motor, a propulsive force generator to be driven by the electric motor to generate a propulsive force, an operator to be operated by a user to adjust the power output of the electric motor, and a controller. The controller is configured or programmed to control the power output of the electric motor based on the operation of the operator, and to change the power output gain characteristic of the electric motor with respect to the operation amount of the operator in response to a gain change command.

With this arrangement, the power output gain characteristic of the electric motor with respect to the operation amount of the operator is changed in response to the gain change command. With a smaller power output gain with respect to the operation amount, therefore, the power output of the electric motor is changed in a smaller amount when the operation amount is changed. This makes it possible to finely adjust the power output. Thus, the smaller gain is suitable for low speed sailing. In particular, the smaller gain is advantageous during low speed sailing in a harbor, during docking to a berth, during undocking from a berth, and during trolling, for example. During high speed sailing, on the other hand, the responsiveness with respect to the operation amount is important and, therefore, a larger power output gain is suitable for high speed sailing. Particularly, the larger gain is advantageous when the marine vessel sails toward a destination on the open sea.

Since the power output gain with respect to the operation amount of the operator is thus able to be changed, the power output is properly controlled by operating the single operator during low speed sailing and during high speed sailing. That is, it is possible to easily finely adjust the power output of the electric motor during low speed sailing, while taking full advantage of the power output capacity of the electric motor during high speed sailing.

Depending on the circumstances and the user's preference, it is often desirable to sail the marine vessel primarily in consideration of reducing energy consumption rather than in consideration of a larger propulsive force. In this case, the power output of the electric motor is easily adjusted to a level not larger than necessary by reducing the power output gain with respect to the operation amount. Thus, the energy consumption is effectively reduced.

According to a preferred embodiment of the present invention, a marine vessel electric propulsion system further includes a gain change command generator to generates the gain change command and to input the gain change command to the controller. With this arrangement, the power output gain of the electric motor with respect to the operation amount of the operator is changed in response to the gain change command generated by the gain change command generator.

According to a preferred embodiment of the present invention, the gain change command generator includes a gain change operator to be operated by the user to change the gain characteristic. The gain change operator may be an operation button, an operation lever or the like.

The gain change command generator may include sensors such as a marine vessel speed sensor. For example, the controller may be configured or programmed to detect the gain change command when a marine vessel speed detected by the marine vessel speed sensor is changed across a threshold.

According to a preferred embodiment of the present invention, the controller internally generates the gain change command based on the sailing state of the marine vessel to which the marine vessel electric propulsion system is mounted. With this arrangement, the power output gain characteristic of the electric motor with respect to the operation amount of the operator is automatically changed based on the sailing state of the marine vessel. Therefore, the user allows the controller to determine the state of the marine vessel for the change of the gain.

According to a preferred embodiment of the present invention, the controller is configured or programmed to determine, based on the position of the marine vessel measured by a positioning device, whether the marine vessel is sailing in a low speed sailing area. The controller is preferably configured or programmed to change the gain characteristic so as to reduce the power output gain of the electric motor with respect to the operation amount of the operator, if the marine vessel is sailing in a low speed sailing area. Further, the controller may be configured or programmed to change the gain characteristic so as to increase the power output gain of the electric motor with respect to the operation amount of the operator, if the marine vessel is sailing outside a low speed sailing area.

According to a preferred embodiment of the present invention, the controller is configured or programmed to determine the sailing state based on the marine vessel speed detected by the marine vessel speed sensor or the rotation speed of the electric motor. The controller may determine that the sailing state of the marine vessel is a low speed sailing state if the marine vessel speed is not higher than a threshold. The controller may determine that the sailing state of the marine vessel is a high speed sailing state if the marine vessel speed is higher than the threshold. The threshold for the determination may be a single threshold or may include two or more thresholds. The controller is preferably configured or programmed to change the gain characteristic so as to reduce the gain of the electric motor with respect to the operation amount of the operator if the sailing state is the low speed sailing state. Further, the controller may be configured or programmed to change the gain characteristic so as to increase the gain of the electric motor with respect to the operation amount of the operator if the sailing state is the high speed sailing state.

According to a preferred embodiment of the present invention, the controller is configured or programmed to control the power output of the electric motor based on any one of a plurality of gain characteristics in response to the gain change command. In this case, the gain characteristics preferably include a first gain characteristic and a second gain characteristic that has a smaller gain than the first gain characteristic.

The gain characteristic may be a characteristic having a constant gain. In this case, the gain characteristic is such that the power output of the electric motor is linearly changed with respect to the operation amount of the operator. In a typical case, the power output of the electric motor is proportional to the operation amount of the operator. The gain characteristic may be a characteristic having a gain which varies based on the operation amount. In this case, the gain characteristic is such that the power output of the electric motor is nonlinearly changed with respect to the operation amount. The nonlinear gain characteristic is preferably a gain characteristic having a relatively small gain for a small operation amount range and a relatively large gain for a large operation amount range.

According to a preferred embodiment of the present invention, the first gain characteristic includes a lower limit and an upper limit of the operation range of the operator that respectively correspond to a first power output value of the electric motor and a second power output value of the electric motor that is greater than the first power output value. The second gain characteristic is defined such that the lower limit and the upper limit of the operation range of the operator respectively correspond to the first power output value of the electric motor and a third power output value of the electric motor that is greater than the first power output value and smaller than the second power output value.

For example, the lower limit of the operation range of the operator, i.e., the lower limit of the operation amount, is expressed as 0%, and the upper limit of the operation range of the operator, i.e., the upper limit of the operation amount, is expressed as 100%. Further, the power output range of the electric motor is expressed, for example, as 0% to 100%. In this case, the first power output value for an operation amount of 0% may be 0%, and the second power output value for an operation amount of 100% may be 100% in the first gain characteristic. In the second gain characteristic, the third power output value for an operation amount of 100% may be not greater than 50%, preferably not greater than about 40%, more preferably not greater than 30%.

The first gain characteristic is preferably such that the power output of the electric motor is monotonically linearly or nonlinearly increased with respect to the operation amount. Similarly, the second gain characteristic is preferably such that the power output of the electric motor is monotonically linearly or nonlinearly increased with respect to the operation amount. Where the gain characteristics are each defined such that the power output of the electric motor is monotonically nonlinearly increased, a lower gain is preferably provided for the small-operation amount range in the gain characteristics.

According to a preferred embodiment of the present invention, the third power output value is not greater than about 40% of the second power output value. With this arrangement, the first gain characteristic is suitable for high speed sailing, while the second gain characteristic is suitable for low speed sailing.

According to a preferred embodiment of the present invention, the controller is configured or programmed to change the gain characteristic based on a condition that the operation amount of the operator is a predetermined level or less. With this arrangement, the gain characteristic is changed when the operation amount of the operator is the predetermined level or less. When the power output of the electric motor is large, therefore, the gain characteristic is not changed. Accordingly, the change amount of the power output of the electric motor is reduced when the gain characteristic is changed. This makes it possible to provide an operation system which is able to change the gain and yet provide comfortable operability.

According to a preferred embodiment of the present invention, the controller is configured or programmed to control the rotation speed of the electric motor based on the operation of the operator. With this arrangement, the rotation speed gain of the electric motor with respect to the operation amount of the operator is changed by changing the gain characteristic. Since the rotation speed of the electric motor directly corresponds to the propulsive force generated by the propulsive force generator, the responsiveness of the propulsive force with respect to the operation of the operator is changed by changing the gain characteristic.

According to a preferred embodiment of the present invention, the marine vessel electric propulsion system includes an outboard motor unit which includes the electric motor and the propulsive force generator, and is mounted on an outer portion of the marine vessel in a steerable manner.

With this arrangement, preferred embodiments of the present invention are each applicable to an electric propulsion unit used as an outboard motor, i.e., to an electric outboard motor. In a relatively small-scale marine vessel, the electric outboard motor is often mounted alone without an outboard engine also mounted. In this case, the power output is finely adjusted by reducing the gain in a small power output range. In a large power output range, the gain is increased such that a sufficient power output and responsiveness is provided. The gain may be reduced based on the circumstances and the user's preference to reduce energy consumption.

According to a preferred embodiment of the present invention, a marine vessel includes a hull, and a marine vessel electric propulsion system including any of above-described features mounted on the hull. With this arrangement, the marine vessel is able to finely adjust the power output during low speed sailing, and provide a sufficient level of power output during high speed sailing. Further, the marine vessel is able to sail based on the circumstances and the user's preference while reducing energy consumption.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
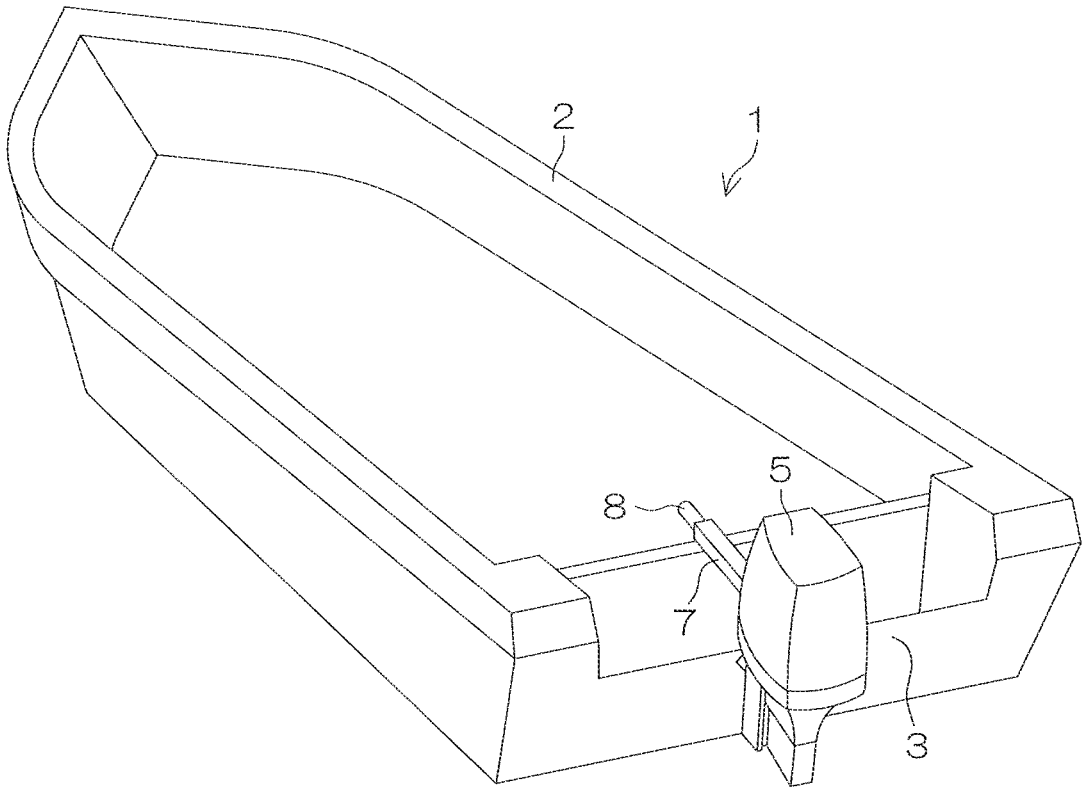
FIG. 1 is a schematic perspective view showing the construction of a marine vessel including an electric propulsion system according to a preferred embodiment of the present invention by way of example.

FIG. 1 is a schematic perspective view showing the construction of a marine vessel including an electric propulsion system according to a preferred embodiment of the present invention by way of example. The marine vessel 1 includes a hull 2 and an electric propulsion system 5. In the present preferred embodiment, the electric propulsion system 5 is an electric outboard motor.

Figure 2:
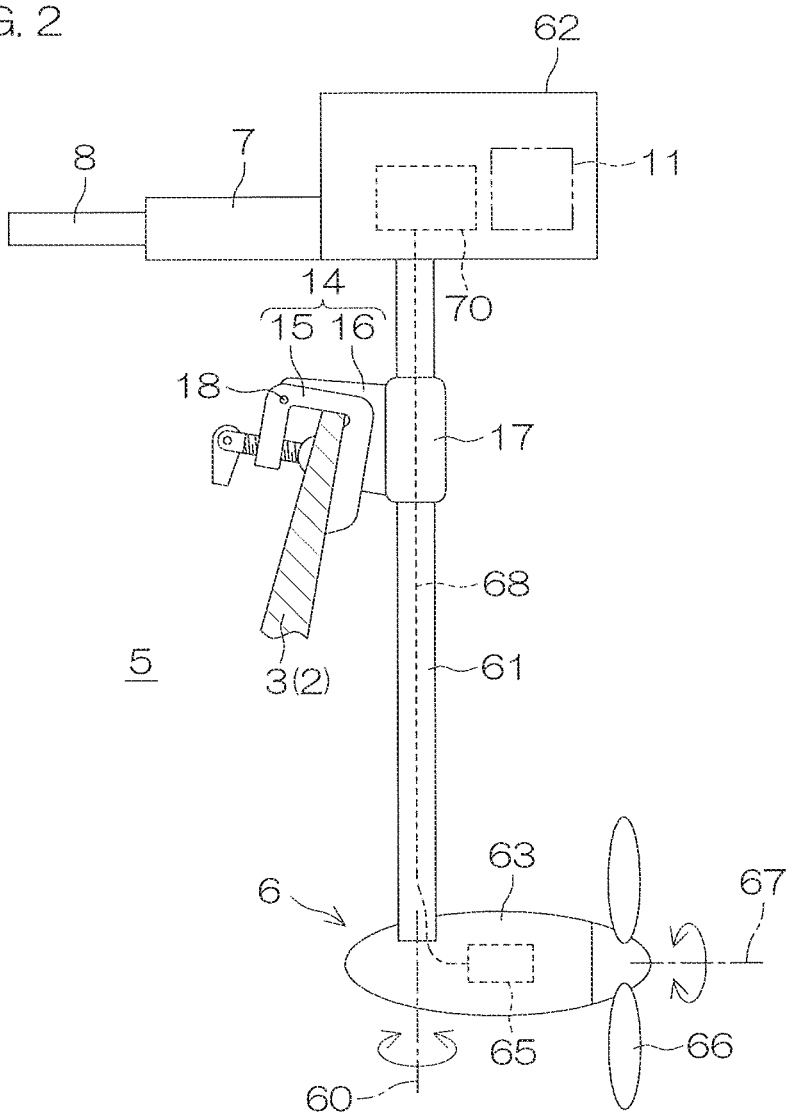
FIG. 2 is a schematic overall structural diagram showing the construction of the electric propulsion system by way of example.

FIG. 2 is an overall structural diagram of the electric propulsion system 5. The electric propulsion system 5 includes an outboard unit 6, and an attachment unit 14 which attaches the outboard unit 6 to the hull 2. The attachment unit 14 includes a clamp bracket 15 and a swivel bracket 16. In the present preferred embodiment, the clamp bracket 15 clamps a stern board 3 of the hull 2. The swivel bracket 16 is attached to the clamp bracket 15 pivotally about a tilt shaft 18. The tilt shaft 18 extends transversely to the hull 2. The swivel bracket 16 includes a bearing 17. The bearing 17 supports the outboard unit 6 with respect to the tilt shaft 18 pivotally about a vertical steering axis 60.

The outboard unit 6 includes a steering shaft 61 extending through the bearing 17 and held pivotally by the bearing 17, an upper case 62 fixed to an upper end of the steering shaft 61, and a lower case 63 fixed to a lower end of the steering shaft 61. The steering shaft 61 is a hollow shaft, i.e., a tubular shaft. An electric motor 65 is accommodated in the lower case 63. A propeller 66 is rotatably attached as the propulsive force generator to the lower case 63. The electric motor 65 is connected to the propeller 66, and rotates the propeller 66 about a propeller axis 67. A controller 70 is accommodated in the upper case 62. The controller 70 and the electric motor 65 are electrically connected to each other by a cable 68 which extends through the steering shaft 61.

A tiller handle 7 extends from the upper case 62 toward the hull 2. An accelerator grip 8 defines and functions as the operator at an end of the tiller handle 7. The accelerator grip 8 is held and operated by a user, and is rotatable about the axis of the tiller handle 7. The user operates the tiller handle 7 to pivot the outboard unit 6 about the steering axis 60 to change the direction of a propulsive force to be generated by the outboard unit 6. Further, the user operates the accelerator grip 8 to change the magnitude of the propulsive force to be generated by the outboard unit 6.

Figure 3:
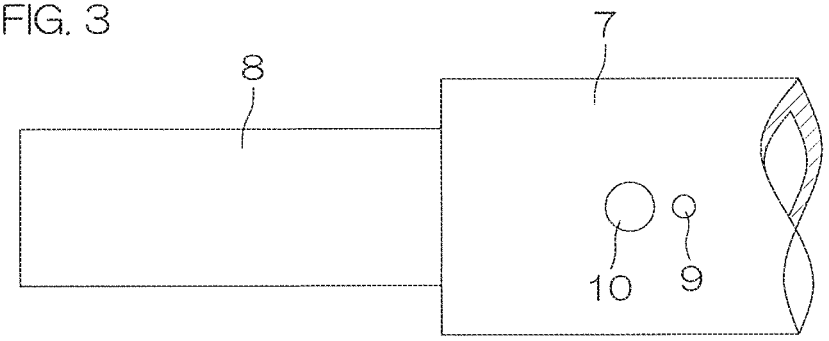
FIG. 3 illustrates the arrangement of an accelerator grip and a mode switch by way of example.

As schematically shown on a greater scale in FIG. 3, a mode switch 10 and an indicator 9 are provided adjacent to the accelerator grip 8 on the tiller handle 7. The mode switch 10 is an element to be operated by the user to switch a gain mode between a low speed sailing mode and an ordinary mode (high speed sailing mode), and is an example of the gain change command generator and the gain change operator. The gain mode is a control mode of the controller 70 to control the power output gain of the electric motor 65 with respect to the operation amount of the accelerator grip 8.

The indicator 9 indicates the gain mode selected by the mode switch 10. For example, the indicator 9 may be lit when the low speed sailing mode is selected, and unlit when the ordinary mode is selected. Alternatively, the indicator 9 may double as a pilot lamp which indicates the on and off of power supply to the electric propulsion system 5, and may flicker when the low speed sailing mode is selected, and to be continuously lit when the ordinary mode is selected.

Figure 4:
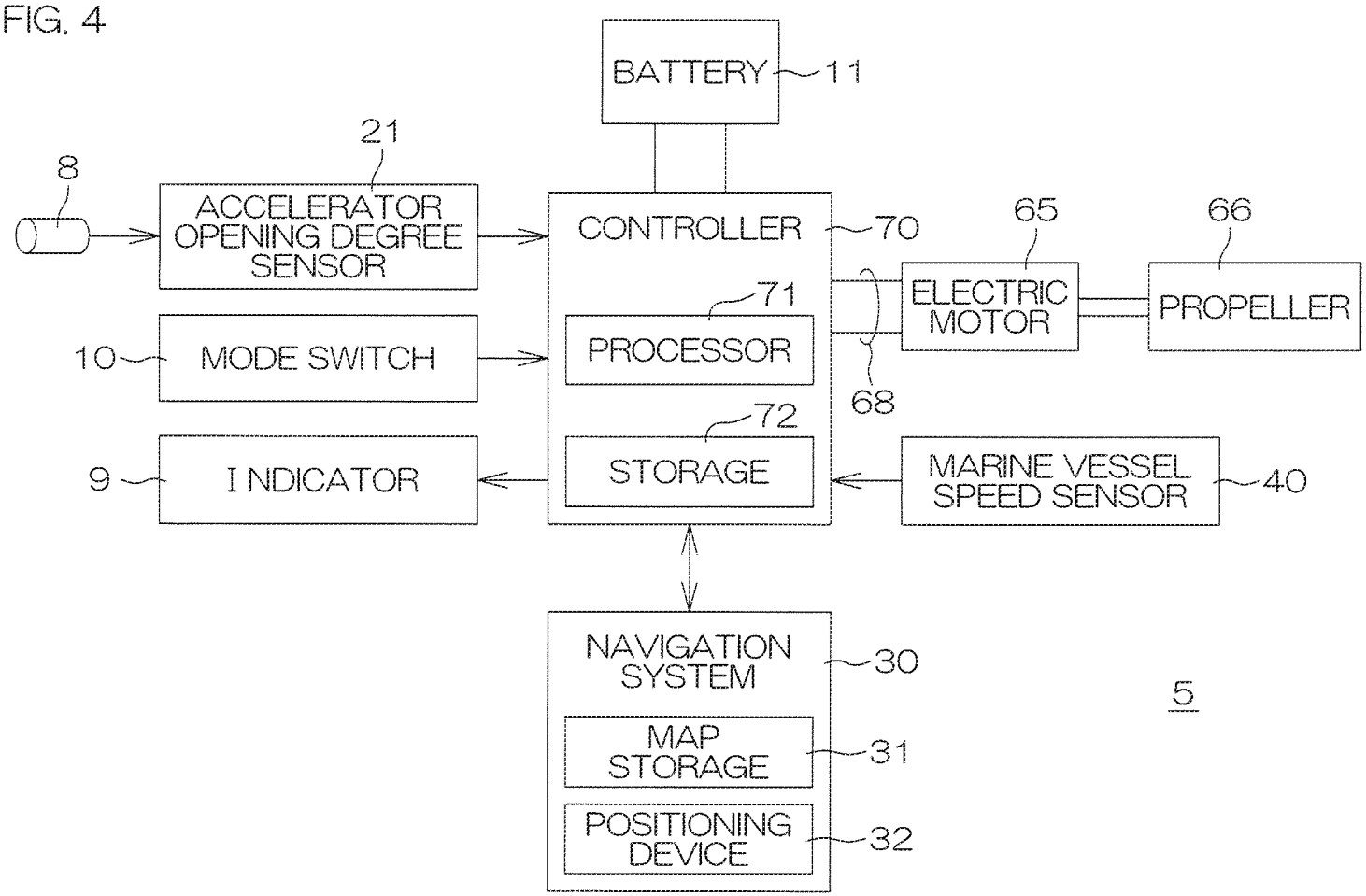
FIG. 4 is a block diagram for describing the electrical configuration of the electric propulsion system by way of example.

FIG. 4 is a block diagram for describing the electrical configuration of the electric propulsion system 5 by way of example. The electric motor 65 is connected to the controller 70 through the cable 68 to receive power supply from the controller 70. The controller 70, which is connected to a battery 11, is operated with power generated by the battery 11, and supplies the power generated by the battery 11 to the electric motor 65. The battery 11 may be accommodated in the upper case 62 as shown in FIG. 2, or may be located in an appropriate place in the hull 2 and connected to the controller 70 in the upper case 62 through a power cable.

An accelerator opening degree sensor 21 (accelerator position sensor) which detects an accelerator opening degree (the operation amount of the accelerator grip 8) is connected to the controller 70. Further, the mode switch 10 is connected to the controller 70. The indicator 9 is also connected to the controller 70.

The controller 70 includes a processor 71 (CPU) and a storage 72. The storage 72 stores a program to be executed by the processor 71. The processor 71 executes the program, such that the controller 70 functions as a motor controller to control the electric motor 65. Further, the storage 72 stores a gain characteristic which defines the rotation speed gain of the electric motor 65 with respect to the accelerator opening degree. In the present preferred embodiment, a plurality of gain characteristics are stored in the storage 72.

In the present preferred embodiment, the controller 70 controls the rotation speed of the electric motor 65. More specifically, the controller 70 computes a target rotation speed based on the accelerator opening degree, and computes a target torque based on a deviation of the actual rotation speed of the electric motor 65 from the target rotation speed. The controller 70 computes a target electric current for the target torque, and performs an electric current feedback control operation on the electric motor 65 based on the target electric current.

Figure 5:
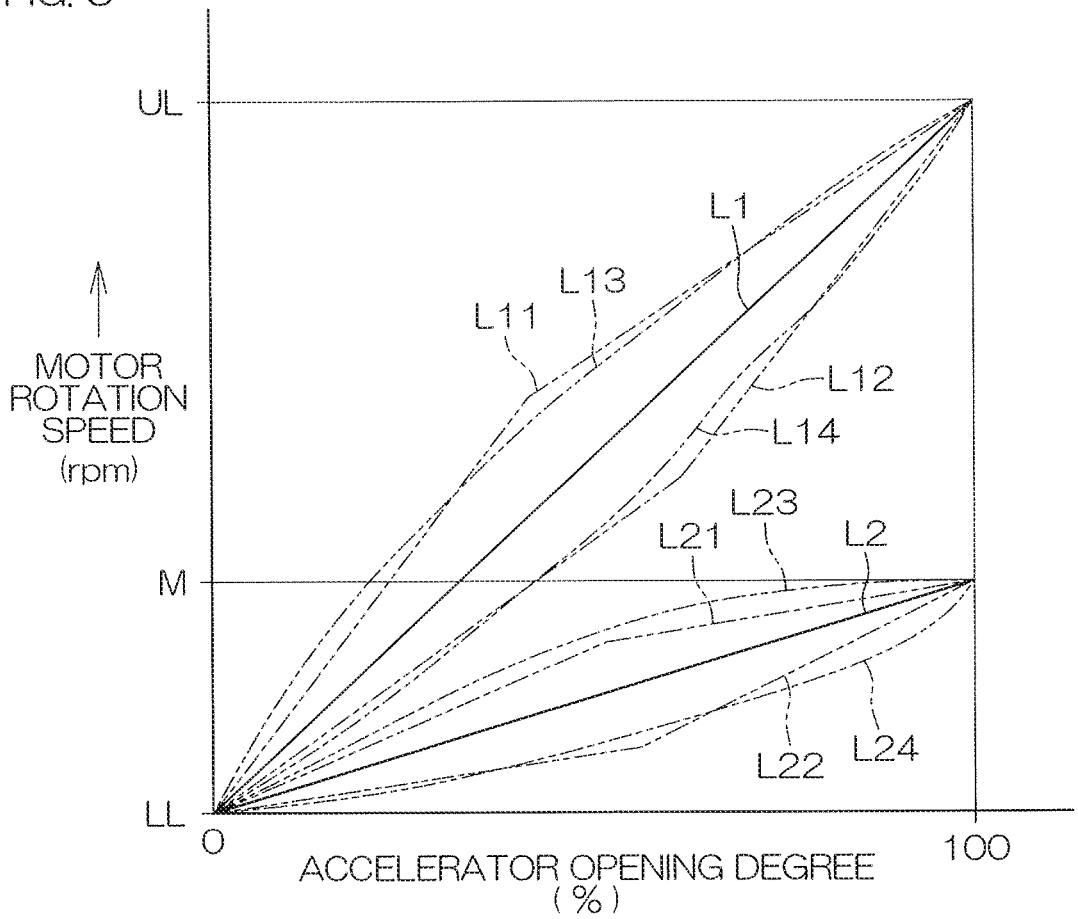
FIG. 5 is a characteristic diagram showing electric motor rotation speed characteristics with respect to the accelerator opening degree by way of example.

FIG. 5 is a characteristic diagram showing the rotation speed (target rotation speed) characteristics of the electric motor 65 with respect to the accelerator opening degree by way of example. In FIG. 5, a line L1 indicates a characteristic in the ordinary mode, and a line L2 indicates a characteristic in the low speed sailing mode. The accelerator opening degree varies within a range (operation range) between a lower limit of 0% and an upper limit of 100%. The controller 70 controls the rotation speed of the electric motor 65 within a range between a lower limit rotation speed LL (an example of the first power output value, e.g., 0 rpm) and an upper limit rotation speed UL (an example of the second power output value, e.g., 2,000 rpm) based on the accelerator opening degree and the selected mode.

In the ordinary mode, as indicated by the line L1, the lower limit rotation speed LL (e.g., 0 rpm) is correlated with a lower limit accelerator opening degree of 0%, and the upper limit rotation speed UL is correlated with an upper limit accelerator opening degree of 100%. Along the line L1, the motor rotation speed is linearly changed with respect to the accelerator opening degree. More specifically, the motor rotation speed is proportional to the accelerator opening degree. That is, the line L1 indicates a characteristic which defines a constant gain G1 irrespective of the accelerator opening degree. The inclination of the line L1 is the gain G1. The gain characteristic for the ordinary mode (in the present preferred embodiment, the constant gain G1 irrespective of the accelerator opening degree) corresponds to the first gain characteristic.

In the low speed sailing mode, as indicated by the line L2, the lower limit rotation speed LL (e.g., 0 rpm) is correlated with a lower limit accelerator opening degree of 0%. Further, an intermediate rotation speed M (an example of the third power output value, e.g., 600 rpm) which is lower than the upper limit rotation speed UL is correlated with an upper limit accelerator opening degree of 100%. Along the line L2, the motor rotation speed is linearly changed with respect to the accelerator opening degree. More specifically, the motor rotation speed is proportional to the accelerator opening degree. That is, the line L2 indicates a characteristic which defines a constant gain G2 irrespective of the accelerator opening degree. The inclination of the line L2 is the gain G2. The gain characteristic for the low speed sailing mode (in the present preferred embodiment, the constant gain G2 irrespective of the accelerator opening degree) corresponds to the second gain characteristic. The intermediate rotation speed M is preferably not greater than about 40%, more preferably not greater than 30%, of the upper limit rotation speed UL. Thus, the gain G2 is sufficiently reduced, making it possible to easily finely adjust the rotation speed of the electric motor 65.

A comparison between the lines L1 and L2 indicates that the gain G2 in the low speed sailing mode is smaller than the gain G1 in the ordinary mode.

In the low speed sailing mode, the gain G2 is small and, thus, the rotation speed of the electric motor 65 is changed in a smaller amount with respect to the operation of the accelerator grip 8. Thus, the rotation speed of the electric motor 65 is easily finely adjusted. Even if the upper limit accelerator opening degree is 100% in the low speed sailing mode, however, the rotation speed of the electric motor 65 merely reaches the intermediate rotation speed M. Where a larger power output is necessary or preferred, the ordinary mode may be selected. Thus, the upper limit rotation speed UL is reached with the upper limit accelerator opening degree, so that the capacity of the electric motor 65 is fully utilized.

As indicated by the lines L11, L12, L13, and L14, an accelerator opening degree motor rotation speed characteristic in the ordinary mode may be a nonlinear characteristic (an angled line or a curve). In this case, the gain G1 is represented by a function of the accelerator opening degree, and provides two or more values which vary based on the accelerator opening degree.

As indicated by the lines L21, L22, L23, and L24, an accelerator opening degree motor rotation speed characteristic in the low speed sailing mode may be a nonlinear characteristic (an angled line or a curve). In this case, the gain G2 is represented by a function of the accelerator opening degree, and provides two or more values which vary based on the accelerator opening degree.

In any of these characteristics, a relationship of G2<G1 is preferably satisfied for a given accelerator opening degree.

Where the accelerator opening degree motor rotation speed characteristic is a nonlinear characteristic (an angled line or a curve), the characteristic is preferably such that the gain is relatively small in a small accelerator opening degree range and is relatively large in a large accelerator opening degree range, particularly, in the low speed sailing mode. Thus, the power output of the electric motor 65 is more easily finely adjusted in the low speed sailing mode.

Figure 6:
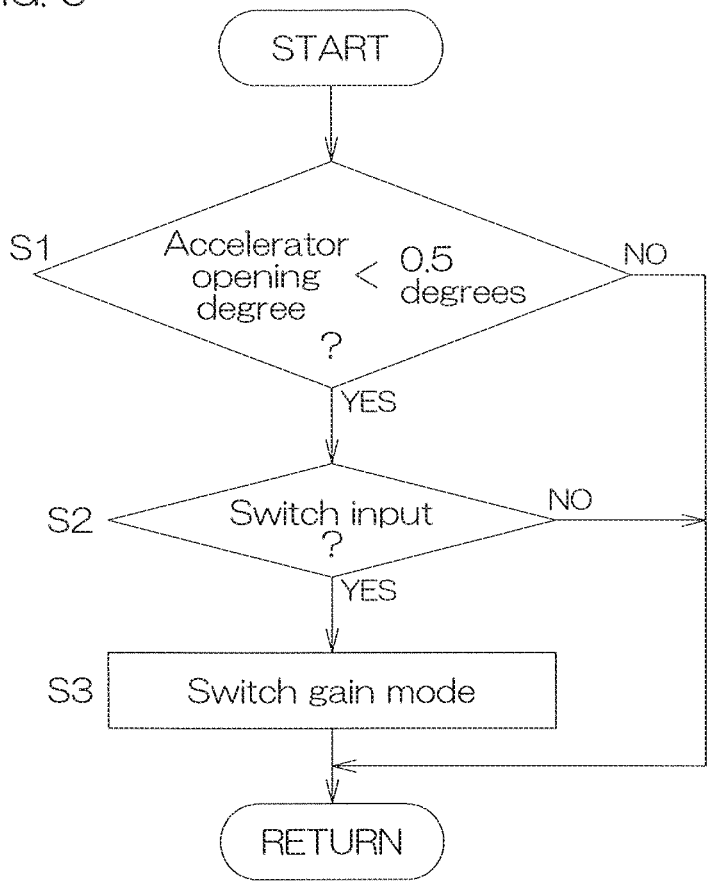
FIG. 6 is a flowchart for describing an exemplary process to be performed by a controller when a mode is switched by operating the mode switch.

FIG. 6 is a flowchart for describing an exemplary process to be performed by the controller 70 (more specifically, an exemplary process to be performed by the processor 71) when the mode is switched by operating the mode switch 10. The controller 70 determines whether the accelerator opening degree is less than a predetermined value (Step S1). The predetermined value may be properly determined in consideration of the user's feeling responsive to switching the gain characteristic. In the exemplary process shown in FIG. 6, the predetermined value is set to 0.5 degrees as defined by the rotation angle of the accelerator grip 8. In Step S1, of course, the determination may be replaced with a determination on whether the accelerator opening degree is not greater than the predetermined value.

If the accelerator opening degree is less than the predetermined value (YES in Step S1), the controller 70 further determines whether a switching input from the mode switch 10 is detected (Step S2). If the switching input from the mode switch 10 is not detected (NO in Step S2), the controller 70 maintains the current gain mode. If the switching input from the mode switch 10 is detected (YES in Step S2), the controller 70 determines that the gain change command is generated, and switches the gain mode (Step S3). That is, if the current gain mode is the ordinary mode, the gain mode is switched to the low speed sailing mode. If the current gain mode is the low speed sailing mode, the gain mode is switched to the ordinary mode. The gain characteristic is changed in response to the switching of the gain mode.

If the accelerator opening degree is not less than the predetermined value (NO in Step S1), the controller 70 does not switch the gain mode. Even if the mode switch 10 is operated, the controller 70 maintains the current gain mode. Therefore, the current gain characteristic is maintained.

Figure 7:
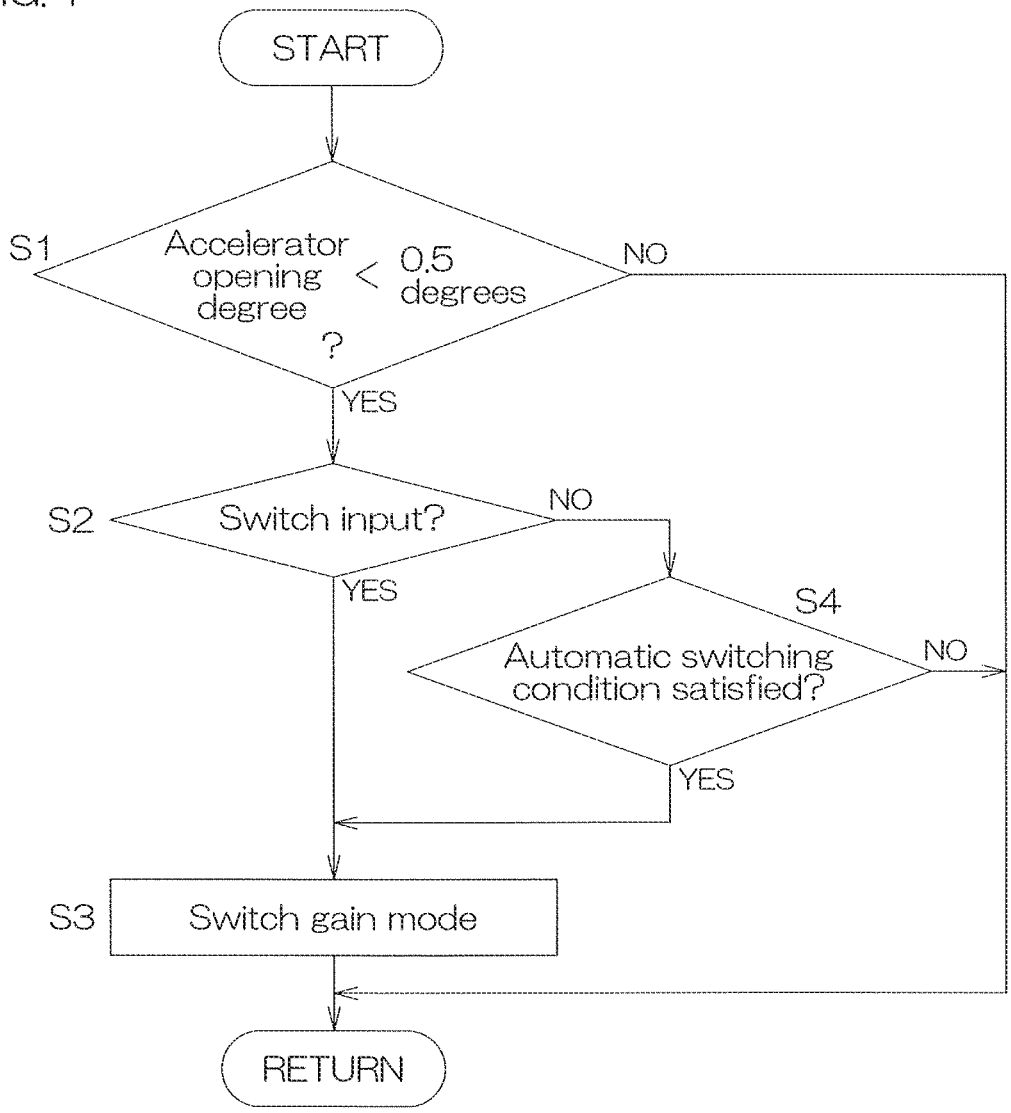
FIG. 7 is a flowchart for describing another exemplary process to be performed to switch the gain mode.

FIG. 7 is a flowchart for describing another exemplary process to be performed to switch the gain mode. In FIG. 7, the same steps as in FIG. 6 are denoted by the same reference characters as in FIG. 6. In this exemplary process, if the accelerator opening degree is less than the predetermined value (YES in Step S1), the controller 70 determines whether the input from the mode switch 10 is detected (Step S2), and additionally determines whether an automatic switching condition is satisfied (Step S4). That is, even if the switching input from the mode switch 10 is not detected (NO in Step S2) but if the automatic switching condition is satisfied (YES in Step S4), the gain mode is switched (Step S3). If the switch input from the mode switch 10 is not detected (NO in Step S2) and if the automatic switching condition is not satisfied (NO in Step S4), the current gain mode is maintained.

The automatic switching condition may include a condition on whether or not the sailing area of the marine vessel 1 is a low speed sailing area such as an area in a harbor. For example, the automatic switching condition may include a condition that the marine vessel 1 is sailing into the low speed sailing area in the ordinary mode. If this automatic switching condition is satisfied, the controller 70 internally generates the gain change command to automatically switch the gain mode from the ordinary mode to the low speed sailing mode. Further, the automatic switching condition may include a condition that the marine vessel 1 is sailing out of the low speed sailing area in the low speed sailing mode. If this automatic switching condition is satisfied, the controller 70 internally generates the gain change command to automatically switch the gain mode from the low speed sailing mode to the ordinary mode.

The controller 70 may determine the sailing area of the marine vessel 1 by utilizing a navigation system 30 connected to the controller 70 as shown in FIG. 4. The navigation system 30 includes a map storage 31 which stores map data including, for example, low speed sailing area information, and a positioning device 32 which measures the current position of the marine vessel 1. The positioning device 32 may include a GNSS (Global Navigation Satellite System) receiver.

The automatic switching condition may include a condition on the sailing state of the marine vessel 1. For example, the controller 70 may determine the sailing state (particularly, the marine vessel speed) based on the output of a marine vessel speed sensor 40 (see FIG. 4) and/or the rotation speed of the electric motor 65. The controller 70 may determine that the marine vessel 1 is in the low speed sailing state if the marine vessel speed is not higher than a threshold. Further, the controller 70 may determine that the marine vessel 1 is in the high speed sailing state if the marine vessel speed is higher than the threshold. The threshold for the determination may be a single threshold or may include two or more thresholds. For example, the automatic switching condition may include a condition that the marine vessel 1 is in the low speed sailing state in the ordinary mode as determined by the controller 70. If this automatic switching condition is satisfied, the controller 70 internally generates the gain change command to automatically switch the gain mode from the ordinary mode to the low speed sailing mode. Further, the automatic switching condition may include a condition that the marine vessel 1 is in the high speed sailing state in the low speed sailing mode as determined by the controller 70. If this automatic switching condition is satisfied, the controller 70 internally generates the gain change command to automatically switch the gain mode from the low speed sailing mode to the ordinary mode.

Where the positioning device 32 is provided as described above, the controller 70 determines the marine vessel speed based on the output of the positioning device 32. Where the positioning device 32 outputs the speed information of the marine vessel 1 in addition to the position information of the marine vessel 1, the controller 70 may use the speed information as the marine vessel speed.

According to the present preferred embodiment, as described above, the gain change command is inputted to the controller 70 by operating the mode switch 10. In response to the gain change command, the gain mode for the power output (in the present preferred embodiment, the rotation speed) of the electric motor 65 with respect to the accelerator opening degree is switched between the ordinary mode and the low speed sailing mode by the controller 70. The gain is relatively large in the ordinary mode, and is relatively small in the low speed sailing mode. With the low speed sailing mode selected, therefore, the power output of the electric motor 65 is changed in a smaller amount when the operation amount of the accelerator grip 8 (the accelerator opening degree) is changed. This makes it possible to finely adjust the power output of the electric motor 65, thus improving the maneuverability of the marine vessel 1 during low speed sailing. Particularly, the marine vessel 1 is easily maneuvered during low speed sailing in a harbor, during docking to a berth, during undocking from a berth, and during trolling, for example. With the ordinary mode selected, on the other hand, the power output of the electric motor 65 is highly responsive to the operation of the accelerator grip 8, and the power output range of the electric motor 65 is effectively utilized. Therefore, a comfortable maneuvering feeling is provided during high speed sailing by selecting the ordinary mode.

Since the power output gain of the electric motor 65 with respect to the accelerator opening degree is changeable, the power output is able to be properly controlled by operating the single accelerator grip 8 during low speed sailing and during high speed sailing. This makes it easier to maneuver the marine vessel 1, and simplifies the structure of the operation system. Further, it is possible to easily finely adjust the power output of the electric motor 65 during low speed sailing, while taking full advantage of the power output capacity of the electric motor 65 during high speed sailing.

It is also possible to use the low speed sailing mode as an eco-mode to reduce energy consumption of the electric motor 65. That is, depending on the circumstances and the user's preference, it is often desirable to sail the marine vessel 1 primarily in consideration of reducing energy consumption rather than in consideration of the sailing comfort provided by a larger propulsive force. In this case, the power output of the electric motor 65 is easily adjusted to a level not greater than necessary by selecting the low speed sailing mode. Thus, the electric propulsion system 5 is able to be driven while effectively reducing energy consumption.

In a preferred embodiment of the present invention, the electric propulsion system 5 is an electric outboard motor. In a relatively small-scale marine vessel 1 as shown in FIG. 1, the electric outboard motor is often mounted alone without also mounting an outboard engine. In this case, the power output is finely adjusted by reducing the gain in a small-power output range. In a large-power output range, a sufficient power output and responsiveness is provided by increasing the gain. Based on the circumstances and the user's preference, the low speed sailing mode may be selected to reduce the gain, such that energy consumption is reduced.

In a preferred embodiment of the present invention, the controller 70 permits the switching of the gain mode based on a condition that the accelerator opening degree is a predetermined value or less. When the power output of the electric motor 65 is large, therefore, the gain characteristic is not changed. Accordingly, the change amount of the power output of the electric motor 65 is reduced when the gain characteristic is changed. This makes it possible to provide a maneuvering system which is able to change the gain and yet provide comfortable maneuverability.

In a preferred embodiment of the present invention, the controller 70 performs a rotation speed control operation to control the rotation speed of the electric motor 65 based on the accelerator opening degree. Since the rotation speed of the electric motor 65 directly corresponds to the propulsive force generated by the propeller 66, the responsiveness of the propulsive force with respect to the operation of the accelerator grip 8 is directly changed by changing the gain characteristic.

In the exemplary process shown in FIG. 7, the controller 70 internally generates the gain change command based on the sailing state of the marine vessel 1, and changes the gain mode in response to the gain change command thus internally generated. Thus, the power output gain characteristic of the electric motor 65 with respect to the accelerator opening degree is automatically changed. Therefore, the user allows the controller 70 to determine the state of the marine vessel 1 for the change of the gain.

While preferred embodiments of the present invention have thus been described, the present invention may be embodied in other ways.

In a preferred embodiment described above, the two gain modes are provided, and the gain characteristic is switched between the two gain characteristics by way of example. Alternatively, three or more gain characteristics may be provided, and the gain characteristic may be switched between these gain characteristics.

In the exemplary process shown in FIG. 7, a selecting switch may be provided to permit the user to selectively enable and disable the automatic gain characteristic changing function.

In a preferred embodiment described above, the propulsion device is an electric outboard motor to be turned by the tiller handle 7 by way of example. A preferred embodiment of the present invention is applicable to a marine vessel including a steering mechanism to turn the outboard unit in response to the operation of a steering wheel. In this case, an operator (e.g., an operation lever) to be operated to control the power output of the electric motor 65 and the mode switch are preferably provided in the vicinity of the steering wheel.

In a preferred embodiment described above, the rotation speed control operation is performed to control the rotation speed of the electric motor 65 by way of example. Alternatively, a torque control operation may be performed to control the torque of the electric motor 65. More specifically, the controller 70 computes the target torque based on the accelerator opening degree, and computes the target electric current for the target torque. Then, the controller 70 performs the electric current feedback control operation on the electric motor 65 based on the target electric current. For the torque control operation, a gain characteristic which defines the gain of the torque (target torque) with respect to the accelerator opening degree is preferably stored in the storage 72.

In a preferred embodiment described above, the various control operations are performed by the single controller 70 by way of example. Alternatively, two or more controllers may be provided, to which the control operations are assigned. The assignment of the control operations may be properly determined as required. Where a user's seat is located away from an outboard motor unit, for example, a steering wheel and an accelerator/shift lever are provided at the user's seat, and a turning device is provided at the outboard motor unit. In this case, a controller (remote control ECU (electronic control unit)) provided at the user's seat and a controller (outboard motor ECU) provided at the outboard motor unit are connected to each other for communication through a communication cable. In such an arrangement, the mode switch may be provided at the user's seat, and connected to the remote control ECU. The remote control ECU may transmit the mode switch input to the outboard motor ECU. In this case, the operation of the outboard motor ECU is the same as that of the controller 70 in the preferred embodiments described above. Further, the remote control ECU may transmit a gain mode command indicating the gain mode selected by the mode switch to the outboard motor ECU. In this case, the outboard motor ECU controls the electric motor based on the gain mode commanded by the gain mode command. The remote control ECU may compute the target rotation speed and transmit a command of the target rotation speed to the outboard motor ECU. In this case, the remote control ECU computes the target rotation speed based on the gain mode selected by the mode switch and the operation amount of the accelerator/shift lever, and transmits the target rotation speed command to the outboard motor ECU. The outboard motor ECU controls the electric motor based on the target rotation speed command. As described above, the torque control operation may be performed instead of the rotation speed control operation. In this case, the target torque is computed instead of the target rotation speed.

In a preferred embodiment described above, the electric propulsion system 5 is an outboard motor by way of example, but preferred embodiments of the present invention are applicable to other types of electric propulsion systems. Specifically, preferred embodiments of the present invention are applicable to electric propulsion systems such as inboard motors, inboard/outboard motors, and pod motors.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel electric propulsion system comprising:

an electric motor;

a propulsive force generator to be driven by the electric motor to generate a propulsive force;

an operator to be operated by a user within an operation range of the operator to adjust a power output of the electric motor; and a controller configured or programmed to control the power output of the electric motor based on an operation of the operator, and to change a power output gain characteristic of the electric motor with respect to an operation amount of the operator within the operation range of the operator in response to a gain change command.

2. The marine vessel electric propulsion system according to claim 1, further comprising a gain change command generator to generate the gain change command and to input the gain change command to the controller.

3. The marine vessel electric propulsion system according to claim 2, wherein the gain change command generator includes a gain change operator to be operated by the user to change the power output gain characteristic.

4. The marine vessel electric propulsion system according to claim 1, wherein the controller is configured or programmed to internally generate the gain change command based on a sailing state of a marine vessel to which the marine vessel electric propulsion system is mounted.

5. The marine vessel electric propulsion system according to claim 1, wherein the controller is configured or programmed to control the power output of the electric motor based on any one of a plurality of gain characteristics in response to the gain change command; and the plurality of gain characteristics include a first gain characteristic and a second gain characteristic that has a smaller gain than the first gain characteristic.

6. The marine vessel electric propulsion system according to claim 5, wherein the first gain characteristic includes a lower limit and an upper limit of the operation range of the operator that respectively correspond to a first power output value of the electric motor and a second power output value of the electric motor that is greater than the first power output value; and the second gain characteristic is defined such that the lower limit and the upper limit of the operation range of the operator respectively correspond to the first power output value of the electric motor and a third power output value of the electric motor that is greater than the first power output value and smaller than the second power output value.

7. The marine vessel electric propulsion system according to claim 6, wherein the third power output value is not greater than about 40% of the second power output value.

8. The marine vessel electric propulsion system according to claim 1, wherein the controller is configured or programmed to change the power output gain characteristic based on a condition that the operation amount of the operator is a predetermined level or less.

9. The marine vessel electric propulsion system according to claim 1, wherein the controller is configured or programmed to control a rotation speed of the electric motor based on the operation of the operator.

10. The marine vessel electric propulsion system according to claim 1, further comprising an outboard motor unit that includes the electric motor and the propulsive force generator, and is steerably mounted on an outer portion of a marine vessel.

11. A marine vessel comprising:

a hull; and the marine vessel electric propulsion system according to claim 1 mounted on the hull.

* * * * *